United States Patent [19]

Wiberg

[11] 4,170,800

[45] Oct. 16, 1979

[54] SITDOWN PIECE OF FURNITURE CONVERTIBLE INTO A BED

[76] Inventor: Ole Wiberg, Vesterbrogade 180, Copenhagen, Denmark

[21] Appl. No.: 850,388

[22] Filed: Nov. 10, 1977

[30] Foreign Application Priority Data

Nov. 16, 1976 [AT] Austria ..... 8527/76

[51] Int. Cl.[2] ..... A47C 17/16; A47C 17/13

[52] U.S. Cl. ..... 5/45; 5/43; 5/18 R

[58] Field of Search ..... 5/13, 17, 18 R, 44–46, 5/37 R, 12, 43

[56] References Cited

U.S. PATENT DOCUMENTS

| | | | |
|---|---|---|---|
| 794,345 | 7/1905 | Coopersmith | 5/45 |
| 3,284,813 | 11/1966 | Sevcik | 5/17 |
| 3,422,467 | 1/1969 | Wiberg | 5/44 R |
| 3,925,834 | 12/1975 | Johnson et al. | 5/17 |

*Primary Examiner*—Casmir A. Nunberg

*Attorney, Agent, or Firm*—Karl F. Ross

[57] ABSTRACT

A convertible couch or chair has a stationary frame that stands on the floor and which has an upper support surface with a front and a back, and a guide inclined upwardly toward the front. A movable frame has a pair of front legs which rest in the floor at all times, and a back end which can move along the guide between an out position with this back end supported on the front of the stationary frame and an in position with the back end at the back of the stationary frame. A seat cushion is held on the movable frame and a backrest is secured to the stationary frame by a pair of arms that allow pivoting of this backrest on the arms between a seat position erect at the back of the stationary frame and a bed position in front of the front leg of the stationary frame. A back leg on the backrest stands in the floor in this bed position and a loose cushion that normally rests atop the seat cushion is positioned on the frame in the out positions.

10 Claims, 6 Drawing Figures

SITDOWN PIECE OF FURNITURE CONVERTIBLE INTO A BED

FIELD OF THE INVENTION

The invention relates to a sitdown piece of furniture convertible into a bed and having a backrest pivotal by means of arms connected to the seat cushion into the plane of the sitting surface, wherein feet are provided on the rear side of the backrest in the sitting position by means of which the backrest is supported on the floor when swung into the plane of the sitting surface.

BACKGROUND OF THE INVENTION

In known pieces of furniture of this type the sitting cushion is fixed to the furniture frame. Thus it is only possible with the known pieces of furniture to connect the back cushion to the fixed seat cushion so that a lying surface is produced which only extends parallel to the length of the piece of furniture.

OBJECT OF THE INVENTION

It is an object of the present invention to produce a piece of furniture of the above-described type wherein the lying surface can be pivoted with respect to the known arrangement by 90° so that it can extend generally perpendicular to the wall against which the back of the piece of furniture lies. In this manner it is possible to obtain either double-lying surfaces or to convert a simple one-person chair into a bed.

SUMMARY OF THE INVENTION

The object of the invention is attained in that the seat cushion is provided in a known manner on a carriage displaceable out of the furniture frame, the carriage being supported in the pulled-out position at its front side on the floor by legs and at its rear side on the furniture frame. With a piece of furniture built in this manner it is possible to fill the space formed by pulling-out of the carriage with a loose cushion so that the overall length for lying down is defined by the loose cushion, the seat cushion, and the backrest.

For further simplification in order to prevent an accidental rolling-forward of the carriage and simultaneously to obtain a downwardly backwardly inclined position of the sitting surface in the sitting position according to further features of the invention there is provided fixed on the front side of the furniture frame slide blocks or rollers on which the displaceable carriage is supported. With a piece of furniture made according to the invention the carriage is therefore supported in the reclining position at one side on the floor via legs which may be provided with rollers and at the other side by slide blocks or rollers connected not with the carriage but with the furniture frame. In the sitting position of the piece of furniture the lying surface is supported on its front side by the rollers or slide blocks mounted on the furniture frame and on its backside directly on the furniture frame. It is therefore possible to give the sitting surface in the sitting position an inclination which increases sitting comfort.

In order to prevent an accidental disattachment of the carriage from the furniture frame it is suggested to provide the displaceable carriage on its rear side with at least one brace engaging under the furniture frame.

Further features of the invention relate to a particularly advantageous pivoting mechanism for the legs of the displaceable carriage so that in the sitting position only the legs of the furniture frame are visible.

SPECIFIC DESCRIPTION

Figure 1:
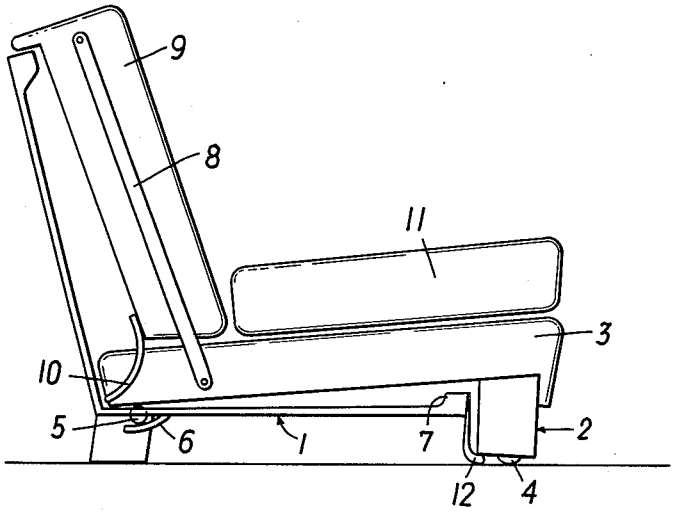
FIG. 1 is a side view of the piece of furniture according to this invention in the sitting position.
Figure 2:
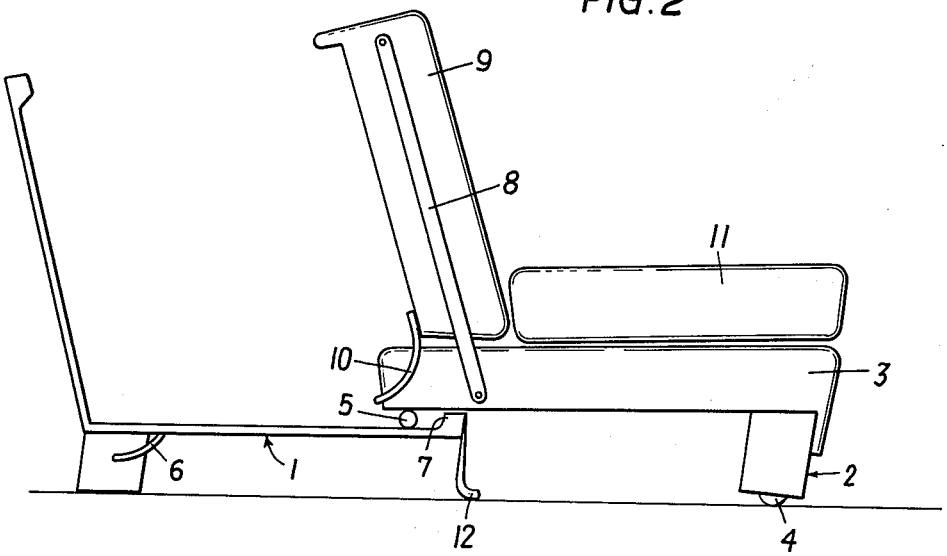
FIG. 2 is a side view showing the piece during conversion.
Figure 3:
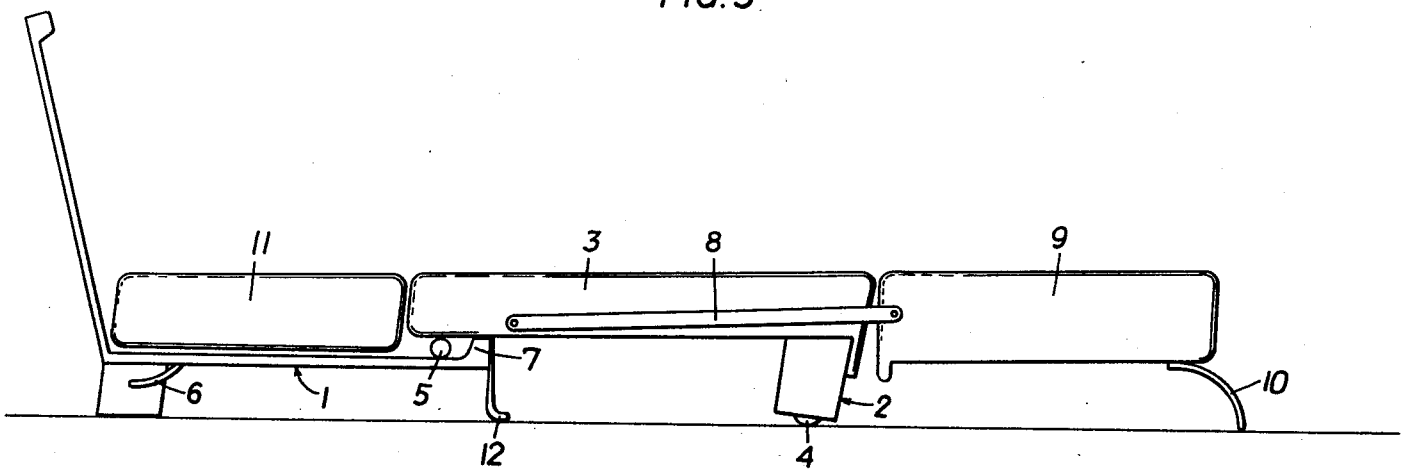
FIG. 3 is a side view showing the piece in the reclining position.

According to FIGS. 1 to 3 the carriage 2 which supports a seat cushion 3 is slidable in a furniture frame 1. The carriage 2 is supported at its front via rollers 4 or slide blocks on the floor and in the back via rollers 5 or slide blocks in guides 6. The guides 6 are therefore advantageously lower at their rear ends than at their front ends, which latter are delimited by a stop 7. Thus the seat cushion is inclined downwardly backwardly in the sitting position and thereby produces a more comfortable sitting position. The guides 6 can also for example be inclined uniformly upwardly from the rear end toward the stop 7, however such an arrangement is hardly easier to use.

Arms 8 pivot the seat cushion 3 on a backrest 9 which is provided on its lower rear end in the sitting position with feet 10.

In the illustrated embodiment a loose cushion 11 lies in the sitting position of the piece of furniture on the seat cushion 3.

The conversion of the piece of furniture from the sitting position into the reclining position takes place as follows:

Pulling out of the carriage 2 or of the thereto connected seat cushion 3 moves this latter into a generally horizontal position according to FIG. 2. This produces behind the seat cushion 3 an empty space into which the loose cushion 11 can be laid. Subsequently a known pivoting of the arms 8 or of the backrest 9 brings this latter member in front of the seat cushion 3 so that the backrest is supported on the floor by the feet 10. The reclining position is shown in FIG. 3.

Figure 4:
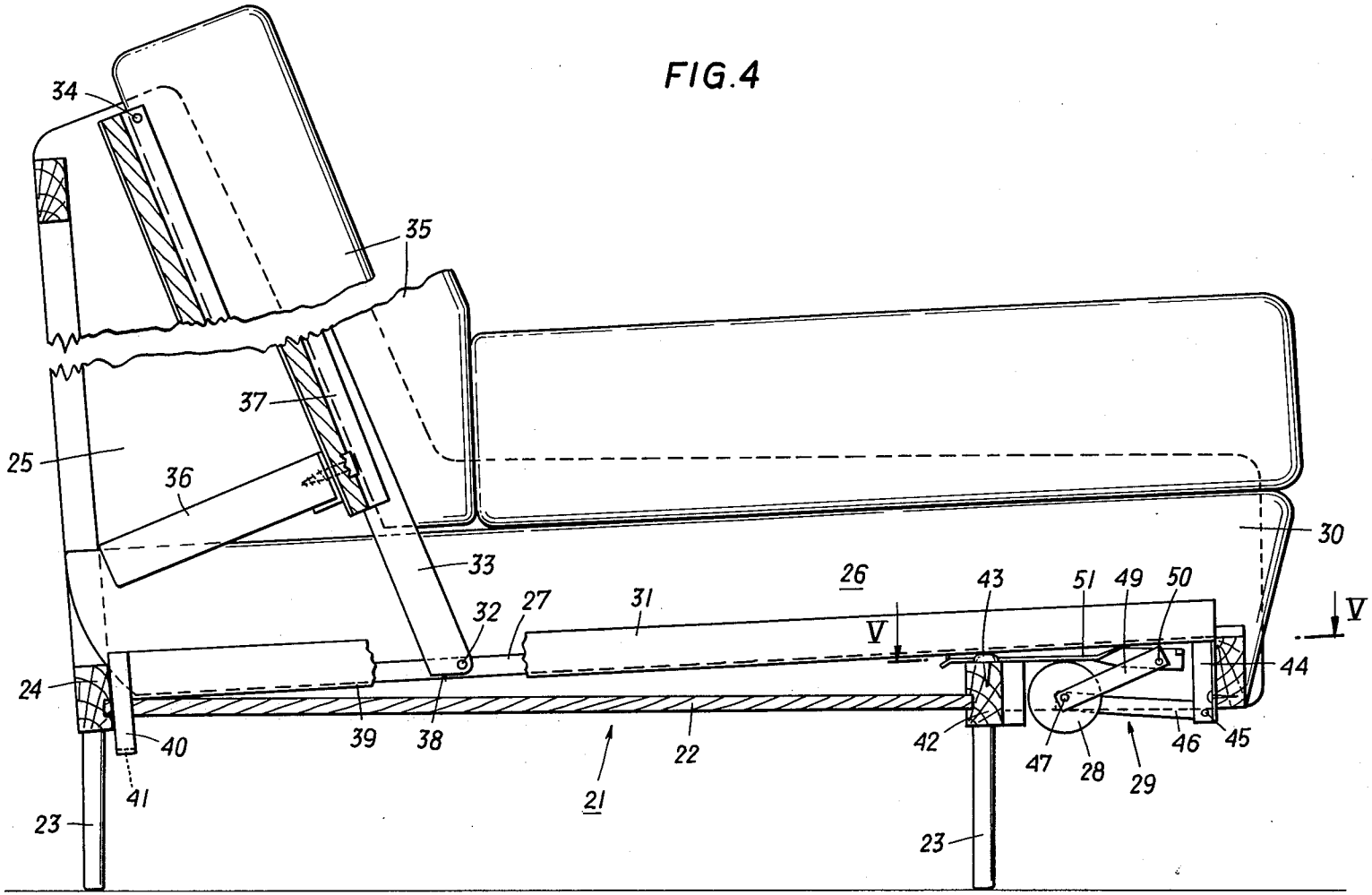
FIG. 4 is a large-scale sectional view through another piece of furniture according to this invention in the sitting position.
Figure 6:
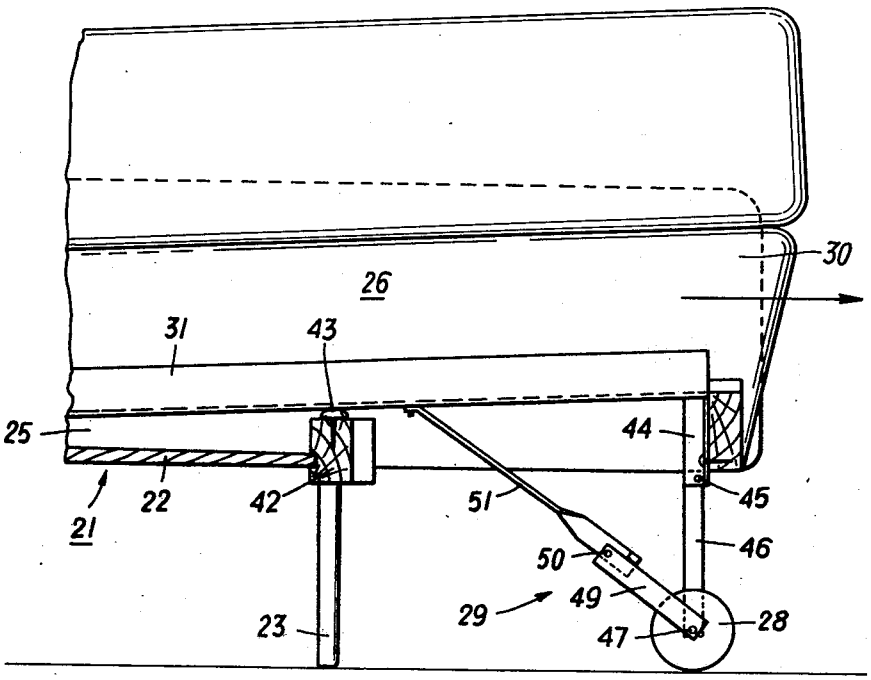
FIG. 6 is a section through the piece of FIG. 4 in the pulled-out position.
Figure 5:
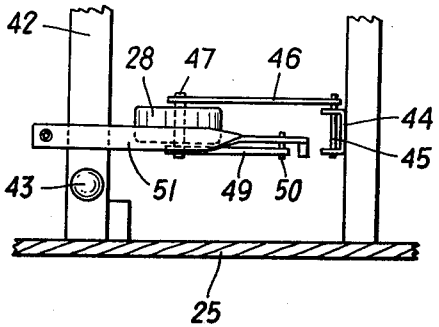
FIG. 5 is a section taken along line V—V of FIG. 4.

In the embodiment according to FIGS. 4 to 6 a furniture frame 21 is comprised of a plate 22, a back wall 24 and side walls 25 with thereto attached legs 23. A carriage 26 displaceable on the furniture frame 21 has a plate 27 which is supported on the floor in the pulled-out position of the carriage by legs 29 having rollers 28. A cushion 30 forming a sitting surface is secured on the upper side of the plate 27. The plate 27 is flanked on its two longitudinal ends by L-section metal elements 31 on each of which is pivoted an arm 33 at 32. Each arm 33 is provided at 34 at its end opposite the pivot 32 with a pivotal backrest 35. Rigid feet 36 are arranged on the side of the backrest 35 in the back in the sitting position (FIG. 1), and these feet 36 are each fixed to an L-section metal element 37. The metal L-section elements 37 embrace the back edges of the backrest 35 and have the same profile as the L-section metal elements 31.

The arms 33 are cut off obliquely at their lower edges 38 so that they lie flatly on the respective abutment-forming horizontal flanges 39 of the L-section elements 31.

At the rear end of the plate 27 of the corresponding end of the element 31 at each side there is secured an L-section element 40 whose horizontal flange 41 engages under the plate 27 so that tipping-up of this element is not possible.

At the front wooden transverse bar 42 of the furniture frame 21 synthetic-resin slide blocks 43 are provided under the L-section metal elements 31 so that the carriage 26 lies at its front end at both sides on the two slide blocks 43.

An arm 46 is pivotal about a bolt 45 on each of the L-section elements 44 and itself carries a wheel 28 rotatable about an axle 47. On the other side of the wheel 28 an arm 49 is pivotal about the axle 47 and has its other end pivoted by means of a bolt 50 on a flat iron member 51. As shown in the drawing both of the flat iron members 51 are twisted and secured with play on the underside of the plate 27 so that they lie in the sitting position (FIG. 4) next to the slide blocks 43 on the transverse wooden beam 42 and on the other hand in the reclining position (FIG. 6) can take a position inclined downwardly toward the floor.

Should it be necessary to bring a piece of furniture according to the invention from the sitting into the reclining position the carriage 26 is pulled out as in the embodiment according to FIGS. 1 to 3, with this carriage sliding on the slide blocks 43. At the end of this motion the L-section elements 40 come against the transverse wooden member 42 and the lower flanges prevent upward displacement of the rear end of the carriage.

During a forward motion of this carriage 26 the flat iron members 51 come out of the region of the transverse wooden member 42 so that the wheels 28 and arms 36 as a result of their weight swing downwardly and the arms 49 and the flat iron members 50 assume an extended position. The carriage 26 is therefore supported at its front end by legs 29 which are formed by the L-section element 45, the arms 46 and 49, as well as the flat iron members 50.

During reconversion of the piece of furniture the flat iron members 51 are pressed upwardly by the transverse wooden bar 42 and the legs 29 are therefore retracted.

The above-given conversion of the piece of furniture takes place as in the embodiment according to FIGS. 1 to 3.

Many changes are possible within the scope of the invention. Thus, for example, instead of the slide blocks 43 rollers can be provided.

I claim:

1. A piece of convertible furniture comprising:

a stationary frame adapted to stand on the floor in all operative positions of said piece of furniture and having an upper support surface with a front and a back;

a movable frame having at least one front leg ahead of said front in all operative positions of said piece of furniture and a back end supported on said support surface of said stationary frame in all operative positions of said piece of furniture, said movable frame being displaceable relative to said stationary frame between an out position with back end supported at said front and said front leg remote from said front and standing on the floor and an in position with said back end at said back and said front leg at said front;

a seat cushion on said movable frame;

a backrest having a front side and a back side;

a back leg at said back side;

at least one arm pivoted on said displaceable frame and on said backrest, said backrest being pivotal on said arms between a seat position generally erect at said back of said stationary frame and a bed position in front of said front leg of said stationary frame, generally coplanar with said seat cushion thereof, and with said back leg standing on the floor; and a loose cushion supported on said seat cushion in said seat and in positions and lying on said stationary frame behind said seat cushion in said bed and out positions.

2. The piece of furniture defined in claim 1 wherein said front leg stands on the floor and supports said movable frame in all operative positions of said piece of furniture.

3. The piece of furniture defined in claim 2 wherein said front leg is provided with a roller riding on the floor.

4. The piece of furniture defined in claim 1 wherein said back leg is adjacent to said back in said seat position.

5. The piece of furniture defined in claim 1 wherein said stationary frame has a guide inclined to the horizontal and along which said movable frame can move, whereby said back edge of said movable frame is raised on displacement of said movable frame from said in position into said out position, said seat cushion being downwardly backwardly inclined in said in position and substantially horizontal in said out position.

6. The piece of furniture defined in claim 5 wherein said fixed frame is provided with means on said guide for sliding of said movable frame between said in and out positions with reduced friction.

7. The piece of furniture defined in claim 1 wherein said movable frame has a brace reaching under said stationary frame.

8. The piece of furniture defined in claim 1 wherein said front leg is pivotal between a down position engaging the floor and an up position, said piece further comprising means for automatically displacing said front leg from said up position into said down position on displacement of said movable frame into said out position.

9. The piece of furniture defined in claim 8, further comprising means normally urging said front leg into said down position.

10. The piece of furniture defined in claim 1, further comprising a second such arm adjacent the first-mentioned arm, both of said arms being provided with abutments flatly engageable with said stationary frame in said seat position.

* * * * *